US009493722B2

(12) United States Patent
Doyen et al.

(10) Patent No.: US 9,493,722 B2
(45) Date of Patent: Nov. 15, 2016

(54) MARINE LUBRICANT

(75) Inventors: Valérie Doyen, Four (FR); Chantal Herault, Saint Sorlin (FR)

(73) Assignee: Total Raffinage Marketing, Puteaux (FR)

( * ) Notice: Subject to any disclaimer, the term of this patent is extended or adjusted under 35 U.S.C. 154(b) by 700 days.

(21) Appl. No.: 12/933,178

(22) PCT Filed: Mar. 19, 2009

(86) PCT No.: PCT/FR2009/000287

§ 371 (c)(1),
(2), (4) Date: Nov. 1, 2010

(87) PCT Pub. No.: WO2009/125083

PCT Pub. Date: Oct. 15, 2009

(65) Prior Publication Data

US 2011/0077177 A1 Mar. 31, 2011

(30) Foreign Application Priority Data

Mar. 20, 2008 (FR) ..... 08 01532

(51) Int. Cl.
*C10M 129/70* (2006.01)
*C10M 163/00* (2006.01)

(52) U.S. Cl.
CPC ..... *C10M 129/70* (2013.01); *C10M 163/00* (2013.01); *C10M 2207/028* (2013.01);
(Continued)

(58) Field of Classification Search
CPC ..... C10M 129/70; C10M 163/00; C10M 2215/28; C10M 2219/046; C10N 2210/01; C10N 2210/02; C10N 2220/025; C10N 2230/04; C10N 2230/12; C10N 2230/52; C10N 2240/102; C10N 2240/105
USPC ..... 508/463, 100
See application file for complete search history.

(56) References Cited

U.S. PATENT DOCUMENTS

2003/0171223 A1 9/2003 Winemiller et al.
2005/0075254 A1* 4/2005 Pollock et al. ..... 508/486
(Continued)

FOREIGN PATENT DOCUMENTS

CA 2602770 A1 3/2008
CN 1714140 A 12/2005
(Continued)

OTHER PUBLICATIONS

Search Report for related application, Singapore 102006613-2, mailing date Feb. 9, 2012.
(Continued)

*Primary Examiner* — James Goloboy
(74) *Attorney, Agent, or Firm* — IP Attorneys Group, LLC

(57) ABSTRACT

The present invention relates to a cylinder lubricant having a BN, determined according to the ASTM D-2896 standard, of greater than or equal to 40 milligrams of potassium hydroxide per gram of lubricant, comprising a lubricant base oil for a marine engine and at least one overbased detergent that is based on alkali or alkaline-earth metals, and which also contains an amount of 0.01% to 10% by weight relative to the total weight of the lubricant, of one or more compounds (A) chosen from esters of saturated fatty monoacids comprising at least 14 carbon atoms and of alcohols comprising at most 6 carbon atoms.

16 Claims, 1 Drawing Sheet

(52) U.S. Cl.
CPC .... *C10M2207/26* (2013.01); *C10M 2207/262* (2013.01); *C10M 2207/281* (2013.01); *C10M 2207/283* (2013.01); *C10M 2207/289* (2013.01); *C10M 2215/28* (2013.01); *C10M 2219/046* (2013.01); *C10N 2210/01* (2013.01); *C10N 2210/02* (2013.01); *C10N 2220/025* (2013.01); *C10N 2230/04* (2013.01); *C10N 2230/12* (2013.01); *C10N 2230/52* (2013.01); *C10N 2240/102* (2013.01); *C10N 2240/105* (2013.01)

(56) References Cited

U.S. PATENT DOCUMENTS

| | | | | |
|---|---|---|---|---|
| 2005/0209110 | A1* | 9/2005 | Roski et al. | 508/192 |
| 2007/0193535 | A1 | 8/2007 | Garner et al. | |
| 2008/0153723 | A1* | 6/2008 | Boons et al. | 508/150 |

FOREIGN PATENT DOCUMENTS

| | | | | |
|---|---|---|---|---|
| EP | 1 338 641 | A1 | | 8/2003 |
| EP | 1696021 | A | | 8/2006 |
| EP | 1 696 021 | A2 | | 8/2008 |
| JP | 2001019990 | A | * | 1/2001 |
| WO | WO2005112575 | | | 12/2005 |
| WO | 2007/047446 | A1 | | 4/2007 |
| WO | 2008/021737 | A1 | | 2/2008 |
| WO | WO 2008043901 | A2 | * | 4/2008 |
| WO | 2009065903 | A2 | | 5/2009 |

OTHER PUBLICATIONS

Search Report for related application, People's Republic of China, mailing date Sep. 26, 2012.

* cited by examiner

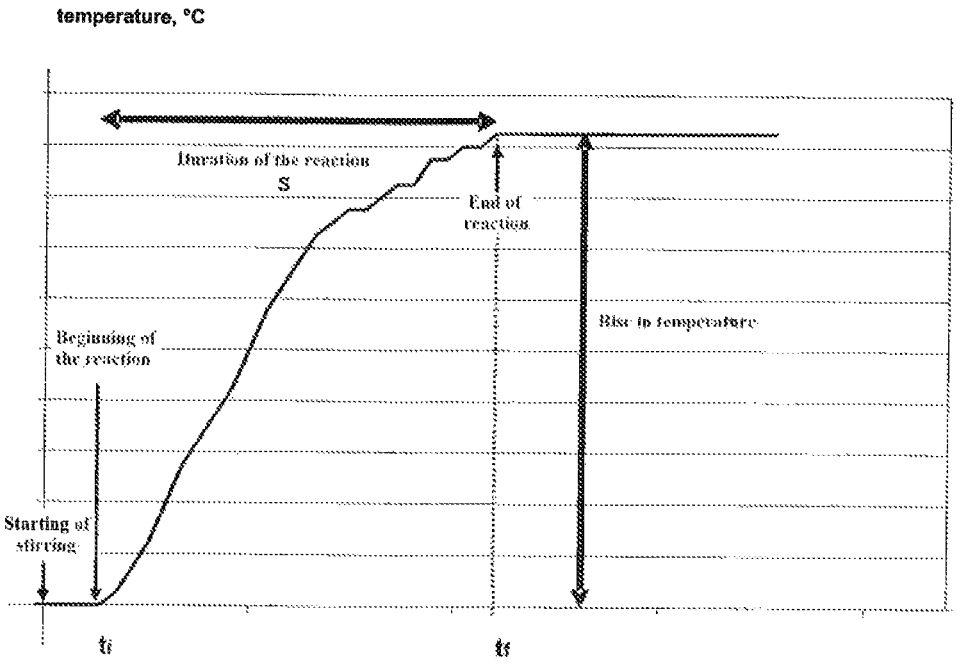
temperature, °C
Duration of the reaction
S
End of
reaction
Rise in temperature
Beginning of
the reaction
Starting of
stirring
ti
tf

MARINE LUBRICANT

CROSS REFERENCE TO RELATED APPLICATIONS

This application is a national phase filing of pending International Patent Application PCT/FR2009/000287 filed on Mar. 19, 2009, which claims priority of French Patent Application No. FR0801532 filed on Mar. 20, 2008. The contents of the above mentioned PCT Application and French Application are relied upon and incorporated herein by reference in their entirety.

FIELD

The present invention relates to a cylinder lubricant for a two-stroke marine engine which may be used both with high sulfur content fuel oils with and low sulfur content fuel oils. It more particularly relates to a lubricant having sufficient neutralization power with regard to the sulfuric acid formed during the combustion of fuels with high sulfur content, while limiting the formation of deposits during the use of fuel oils with low sulfur content.

TECHNOLOGICAL BACKGROUND OF THE INVENTION

Marine oils used in slow two-stroke cross-head engines, are of two types. Cylinder oils on the one hand ensuring lubrication of the piston-cylinder assembly, and system oils on the other hand ensuring lubrication of all the moving parts except for the piston-cylinder assembly. Within the piston-cylinder assembly, combustion residues containing acid gases are in contact with the lubricating oil.

Acid gases are obtained from the combustion of fuel oils; these are notably sulfur oxides ($SO_2$, $SO_3$), which are then hydrolyzed upon contact with moisture present in the combustion gases and/or in the oil. This hydrolysis generates sulfurous acid ($HSO_3$) or sulfuric acid ($H_2SO_4$).

In order to preserve the surface of the cylinder sleeves and to avoid excessive corrosive wear, these acids have to be neutralized, which is generally carried out by reaction with basic sites included in the lubricant.

The neutralization capacity of an oil is measured by its BN or Base Number characterizing its basicity. It is measured according to the ASTM D-2896 standard and is expressed in potash weight equivalents per gram of oil or mg of KOH/g. BN is a standard criterion allowing adjustment of the basicity of cylinder oils with the sulfur content of the fuel oils used, in order to be able to neutralize the totality of the sulfur contained in the fuel, and capable of being transformed into sulfuric acid by combustion and hydrolysis.

Thus, the higher the sulfur content of a fuel oil, the higher should be the BN of marine oil. This is why marine oils with BN varying from 5 to 100 mg KOH/g are found on the market.

Environmental concerns have induced in certain areas notably in coastal areas, requirements as regards limitation of the sulfur level in fuel oils used on ships.

Thus, the MARPOL Annex 6 regulations (Regulations for the Prevention of air pollution from ships) of the IMO (International Maritime Organization) came into force in May 2005. It foresees a maximum sulfur content of 4.5% m/m for heavy fuel oils as well as the creation of areas with controlled emission of sulfur oxides, called SECAs (Sox Emission Control Areas). Ships entering these areas will have to use fuel oils with a maximum sulfur content of 1.5% m/m or any other alternative treatments aiming at limiting Sox emissions in order to observe the specified values. The notation % m/m refers to the mass percentage of a compound based on the total weight of fuel oil or lubricant composition in which it is included.

Ships covering transcontinental routes will then use several types of heavy fuel oils depending on the local environmental constraints and this allows them to optimize their operational costs.

Thus, most container carrier ships presently being built foresee the application of several bunkering tanks, for 'high sea' fuel oil with a high sulfur content on the one hand and for 'SECA' fuel oil with a sulfur content of less than or equal to 1.5% m/m on the other hand.

Switching between both fuel oil categories may require adaptation of the operating conditions of the engine, in particular the application of suitable cylinder lubricants.

Presently, in the presence of high sulfur content fuel oil (3.5% m/m and more) marine lubricants are used having a BN of the order of 70.

In the presence of a low sulfur content fuel oil (1.5% m/m and less), marine lubricants are used having a BN of the order of 40.

In both of these cases, a sufficient neutralization capacity is then attained since the required concentration of basic sites provided by the overbased detergents of the marine lubricant is reached, but it is necessary to change the lubricant at each change in the type of fuel oil.

Further, each of these lubricants has limits of use resulting from the following observations: the use of a BN 70 cylinder lubricant in the presence of a fuel with a low sulfur content (1.5% m/m and less) and a set greasing level, creates a significant excess of basic sites (strong BN) and a risk of destabilization of the unused overbased detergent micelles, which contain insoluble metal salts. This destabilization results in the formation of deposits of insoluble metal salts (for example calcium carbonate), mainly in the piston junk, and may eventually lead to a risk of excessive wear of the cylinder sleeve polishing type.

Consequently, optimization of the lubrication of a slow 2-stroke engine then requires selection of the lubricant with the BN adapted to the fuel oil and to the operating conditions of the engine. This optimization reduces the flexibility of operating the engine and requires great technical skill of the crew in defining conditions under which switching from one type of lubricant to the other should be performed.

In order to simplify the maneuvers, it would therefore be desirable to have a single cylinder lubricant for a 2-stroke marine engine which may be used both with high sulfur content fuel oils and with low sulfur content fuel oils.

SUMMARY OF THE INVENTION

The object of the present invention is to provide a lubricant oil which may ensure proper lubrication of the cylinder of the marine engine and which may both withstand the constraints of high sulfur content fuel oils and the constraints of low sulfur content fuel oils.

For this purpose, the present invention proposes a cylinder lubricant having a BN determined according to the ASTM D-2896 standard, which is greater than or equal to 40 milligrams of potash per gram of lubricant, comprising a lubricating base oil for a marine engine and at least one overbased detergent based on alkaline or earth alkaline metals, characterized in that it further contains an amount from 0.01% to 10%, preferably from 0.1% to 2% by weight based on the total weight of the lubricant, of one or more compounds (A) selected from esters, preferably mono- and di-esters, of saturated fatty mono-acids including at least 14 carbon atoms and of alcohols including at least 6 carbon atoms.

Surprisingly, the Applicant noticed that the introduction of certain types of surfactant compounds in a standard formulation of cylinder lubricant having a determined BN, leads to a strong increase in the efficiency of said standard lubricant with regard to neutralization of the sulfuric acid formed during the combustion of any type of fuel oils for which the sulfur content is less than 4.5% in a 2-stroke marine engine. The improvement in the performance particularly relates to the neutralization rate or kinetics of the formed sulfuric acid which is substantially increased.

This difference in performance between a traditional reference lubricant and the same lubricant with a surfactant additive is characterized by a neutralization efficiency index measured by means of the enthalpy test described in the examples hereafter.

Further, the Applicant noticed that the introduction of these surfactant compounds has no effect or has a negligible effect on the initial value of the BN of said lubricant, as measured by the ASTM D-2896 standard.

Indeed, the Applicant noticed that the BN does not seem to be the only determining criterion for the adaptability of the lubricant to the sulfur content of the fuel oil used. Although providing an indication on the neutralization potential, the BN is not necessarily representative of the availability and accessibility of the constitutive basic sites of the BN with regard to the acid molecules to be neutralized.

Thus, without intending to be bound by any theory, it is possible to consider that these surfactant compounds do not per se provide additional basicity to the lubricant in which they are put into solution. On the other hand, their hydrophilic/lipophilic balance (HLB) during their introduction in a lubricant with a given BN, leads to increasing the accessibility of the basic sites contained in the overbased detergents of the lubricant, and consequently to making the reaction of neutralization of the formed sulfuric acids more efficient during the combustion of the fuel oil.

This allows formulation of a cylinder lubricant for a 2-stroke marine engine both suitable for high sulfur content fuel oils and for low sulfur content fuel oils.

Preferably, the present invention proposes a cylinder lubricant having a determined BN comprised in the range from 40 to 70 milligrams of potash per gram of lubricant, preferably from 45 to 60, preferably from 50 to 58.

According to an embodiment, the BN of the lubricants according to the present invention is comprised between 47 and 53, preferentially equal to 50.

According to another embodiment, the BN of the lubricants according to the present invention is comprised between 54 and 56, preferentially equal to 55.

Further, the BN of the lubricants according to the present invention may be comprised between 55 and 59, preferentially comprised between 56 and 58, preferentially equal to 57.

According to an embodiment, the compounds (A) are selected from mono- and di-esters of saturated fatty mono-acids including at least 14 carbon atoms and of alcohols including at most 6 carbon atoms.

Preferably, the compounds (A) are esters of saturated fatty acids selected from myristic, pentadecylic, palmitic, margaric, stearic, nonadecylic, arachidic, heneicosanoic, behenic acids.

Preferably, the compounds (A) are esters of alcohols selected from ethanol, methanol, propanol, butanol, ethylene glycol, neopentyl glycol, glycerol, pentaerythritol, hexanediol, triethylene glycol.

Esters of myristic, pentadecylic, palmitic, margaric, stearic, nonadecylic, arachidic, heneicosanoic, behenic acids and of ethanol, methanol, propanol, butanol, ethylene glycol, neopentyl glycol, glycerol, pentaerythritol, hexanediol, triethylene glycol, in particular mono- and di-esters, will be preferred.

According to an embodiment, the cylinder lubricant comprises one or more functional additives selected from dispersant additives, anti-wear additives, anti-foam additives, antioxidants and/or anti-rust additives.

According to an embodiment, the cylinder lubricant comprises at least one overbased detergent selected from the group formed by carboxylates, sulfonates, salicylates, naphthenates, and mixed overbased detergents associating at least two of these types of detergents, notably the cylinder lubricant comprises at least 10% of one or more overbased detergent compounds.

According to an embodiment, overbased detergents are compounds based on metals selected from the group formed by calcium, magnesium, sodium or barium, preferentially calcium or magnesium.

According to an embodiment, the detergents are overbased by insoluble metal salts selected from the group of alkaline and earth alkaline metal carbonates, hydroxides, oxalates, acetates, glutamates. Preferably, the overbased detergents are alkaline and earth alkaline metal carbonates or further at least one of the detergents is overbased with calcium carbonate.

According to another embodiment, the cylinder lubricant comprises at least 0.1% of a dispersant additive selected from the family of PIB succinimides.

According to another object, the invention relates to the use of a lubricant as described above, as a single cylinder lubricant which may be used with any type of fuel oils, for which the sulfur content is less than 4.5%, preferably for which the sulfur content is comprised between 0.5 to 4.5% m/m.

Preferably, the single cylinder lubricant may be used both with fuel oils having a sulfur content of less than 1.5% m/m and with fuel oils having a sulfur content of greater than 2.5% m/m, preferentially greater than 3% m/m.

Preferably, the single cylinder lubricant may be used both with fuel oils having a sulfur content of less than 1% m/m and with fuel oils having a sulfur content of greater than 2.5% m/m, preferentially greater than 3% m/m.

According to another object, the invention relates to the use of a lubricant as described above for preventing corrosion and/or reducing formation of a deposit of insoluble metal salts in 2-stroke marine engines during combustion of any type of fuel oil for which the sulfur content is less than 4.5% m/m.

According to another object, the invention relates to the use of one or more compounds selected from esters of saturated fatty mono-acids including at least 14 carbon atoms and of alcohols including at most 6 carbon atoms, as surfactants in a cylinder lubricant having a BN, as measured by the ASTM D-2896 standard, which is greater than or equal to 40 milligrams of potash per gram of lubricant, in order to improve the efficiency of said cylinder lubricant with regard to the neutralization rate of the sulfuric acid formed during the combustion of any type of fuel oils for which the sulfur content is less than 4.5% m/m in a 2-stroke marine engine.

Preferably, the surfactant is present in an amount of 0.01%-10% by weight, preferentially 0.1%-2% by weight based on the total weight of the lubricant.

According to another object, the invention relates to a method for making a lubricant as described above wherein the compound (A) is added as a distinct component of the cylinder lubricant having a BN determined according to the ASTM D-2896 standard, which is greater than or equal to 40 milligrams of potash per gram of lubricant and optionally comprising one or more functional additives.

According to an embodiment, the lubricant is prepared by diluting an additive concentrate for marine lubricant into which the compound (A) is incorporated.

According to another object, the invention relates to a concentrate of additives, for a cylinder lubricant having a BN determined according to the ASTM D-2896 standard, which is greater than or equal to 40 mg of potash per gram of lubricant, said concentrate comprising from 0.05% to 30%, preferably from 0.5% to 25% by weight, based on the total weight of the additive concentrate, of one or more compounds (A) selected from esters of saturated fatty mono-acids including at least 14 carbon atoms and of alcohols including at most 6 carbon atoms.

According to another embodiment, the additive concentrate comprises from 15% to 80% by weight, based on the total weight of the additive concentrate, of one or more compounds (A) selected from mono- and di-esters of saturated fatty mono-acids including at least 14 carbon atoms and of alcohols including at most 6 carbon atoms.

Preferably, in the additive concentrates according to the invention, the esters are mono-esters or di-esters of saturated fatty mono-acids including at least 14 carbon atoms and of alcohols including at most 6 carbon atoms.

Preferably, the compounds (A) of the additive concentrates according to the invention are esters of saturated fatty acids selected from myristic, pentadecylic, palmitic, margaric, stearic, nonadecylic, arachidic, heneicosanoic, behenic acids.

Preferably, the compounds (A) of the additive concentrates according to the invention are esters of alcohols selected from ethanol, methanol, propanol, butanol, ethylene glycol, neopentyl glycol, glycerol, pentaerythritol, hexanediol, triethylene glycol.

In the additive concentrates according to the invention, the esters of myristic, pentadecylic, palmitic, margaric, stearic, nonadecylic, arachidic, heneicosanoic, behenic acids and of ethanol, methanol, propanol, butanol, ethylene glycol, neopentyl glycol, glycerol, pentaerythritol, hexanediol, triethylene glycol will be preferred, in particular the mono- and di-esters of the acids and alcohols mentioned above.

BRIEF DESCRIPTION OF DRAWINGS

FIG. 1 is the measurement of the temperature increase versus time during the neutralization reaction

DETAILED DESCRIPTION OF THE EMBODIMENTS OF THE INVENTION

Esters as Surfactants:

Surfactants are molecules having a chain with lipophilicity (or hydrophobicity) on the one hand, and a group with hydrophilicity (or polar head) on the other hand.

The esters used in the invention are non-ionic surfactants, the hydrophilic polar head of which is represented by the unit formed by the ester groups and the optional non-esterified hydroxyl groups, which should therefore be sufficiently close to each other in order to form such a "polar head". Thus, in the esters according to the invention, the ester functions are in limited number, preferentially one or two, and preferentially are at most distant from each other by four carbon atoms counted from the oxygen side of the ester function.

The non-esterified hydroxyl groups are also in limited number, preferentially not more than four, and located in a beta or gamma position relatively to the oxygen atom of the COO group of the ester function(s).

The lipophilic portion is itself represented by one or more, preferentially at most two carbon chains stemming from fatty acids, which should therefore include a sufficient amount of carbon atoms for imparting sufficient lipophilicity to the molecule and be preferentially free of any polar or unsaturation group.

In the invention, the esters are used alone or as mixture and are selected from the esters of saturated fatty mono-acids including at least 14 carbon atoms, and of alcohols including at most 6 carbon atoms, preferably selected from mono- and di-esters.

Moreover, the aliphatic chain of the saturated fatty acids preferably comprises from 14 to 22 carbon atoms, preferentially from 18 to 20 carbon atoms. The aliphatic chain of these fatty acids is preferentially linear, optionally substituted, preferably with methyl, ethyl or propyl groups.

These acids are for example and preferably selected from myristic, pentadecylic, palmitic, margaric, stearic, nonadecylic, arachidic, heneicosanoic, behenic acids.

The alcohols of the esters according to the invention include at most 6 carbon atoms. These are linear or branched mono- or poly-alcohols. Preferably these are at most tetra-alcohols. These alcohols are preferably selected from ethanol, methanol, propanol, butanol, ethylene glycol, neopentyl glycol, glycerol, pentaerythritol, hexanediol, triethylene glycol.

The esters of myristic, pentadecylic, palmitic, margaric, stearic, nonadecylic, arachidic, heneicosanoic, behenic acids and of ethanol, methanol, propanol, butanol, ethylene glycol, neopentyl glycol, glycerol, pentaerythritol, hexanediol, triethylene glycol, will be preferred in particular mono- and di-esters.

Among the preferred esters, mention may for example be made of methyl esters of stearic acid, of glycerol monostearate, of mono- and di-esters of neopentyl glycol or ethylene glycol and of margaric and stearic acids.

Because of their low surfactant properties or their strong lipophilicity, these compounds are stabilized in solution in the matrix of the oil and tend to displace the chemical equilibrium within overbased detergents. Consequently, the basic sites provided by the overbased detergents are more accessible, which makes the reaction of neutralization of sulfuric acid more efficient by these basic sites provided by the overbased detergents.

Moreover, it is noted that these compounds do not provide per se additional basicity to the lubricant in which they are put into solution.

The amounts of surfactants used in the invention range from 0.01% to 10% by weight based on the total weight of the lubricant.

The viscosity or the gelling level of the final lubricant may vary depending on the nature of the selected ester(s), an amount comprised in the range from 0.1% to 2% by weight of one or more esters based on the total weight of the lubricant will be preferably used. The final marine lubricant according to the invention will thereby be able to retain a viscosimetric grade according to the specifications of use.

BN of the Lubricants According to the Present Invention.

The BN of the lubricants according to the present invention is provided by the overbased detergents based on alkaline or earth alkaline metals. The value of this BN measured according to ASTM D-2896 may vary from 5 to 100 mg of KOH/g in marine lubricants.

A lubricant with a set BN value will be selected depending on the conditions of use of said lubricants and notably according to the sulfur content of the fuel oil used and in association with the cylinder lubricants.

The lubricants according to the present invention are adapted to a use as a cylinder lubricant, regardless of the sulfur content of the fuel oil used as a combustible fuel in the engine.

Consequently, the cylinder lubricants for a two-stroke marine engine according to the invention have a BN greater than or equal to 40, preferentially comprised from 40 to 70.

According to a preferred embodiment of the invention, the lubricant formulation has a BN level, measured according to the ASTM D-2896 standard, intermediate between the levels required for the limiting sulfur contents of the fuel oils currently used, i.e. a BN comprised between 45 and 60, preferably from 50 to 58, preferentially equal to 57 or further 55.

According to an embodiment, the BN of the lubricants according to the present invention is comprised between 47 and 53, preferentially equal to 50.

According to another embodiment, the BN of the lubricants according to the present invention is comprised between 54 and 56, preferentially equal to 55.

Or further, the BN of the lubricants according to the present invention may be comprised between 55 and 59, preferentially comprised between 56 and 58, preferentially equal to 57.

The formulations of the lubricants according to the invention include surfactants of the ester type as described above, allowing increased accessibility to the basic sites provided by the overbased detergents, so as to neutralize the acid at least as effectively as conventional formulations with higher BN.

For example, a lubricant formulation according to the invention having a BN of 55, or 57 will have at least the same efficiency of neutralization of sulfuric acid as a traditional formulation with a BN of 70.

Conventional oils with BN of 55 or 57, thereby reformulated according to the invention give the possibility of properly preventing corrosion problems during the use of fuel oils with high sulfur content (of the order of 3% m/m or more).

An oil according to the present invention also allows a reduction in the formation of deposits of insoluble metal salts providing overbasicity (for example $CaCO_3$) upon the use of fuel oils with low sulfur content (1.5% m/m and less, for example less than 1%), this reduction is directly related to the lowering of the BN made possible in the present formulation configuration.

Moreover, the lubricants according to the present invention keep sufficient detergency capacity when they are formulated both for a use with fuel oils with low and high sulfur content, since their BN (and therefore the present amount of detergents) may be set to an intermediate level between the one required for both fuel oil categories.

Preferably, the lubricants according to the present invention are not in the form of an oil-in-water or water-in-oil emulsion or micro-emulsion where the BN is essentially provided by compounds present in the aqueous phase.

Overbased Detergents.

Overbased detergents used in the lubricant compositions according to the present invention are well-known to one skilled in the art.

The detergents commonly used in formulating lubricating compositions are typically anionic compounds including a long lipophilic hydrocarbon chain and a hydrophilic head. The associated cation is typically a metal cation of an alkaline or earth alkaline metal.

The detergents are preferentially selected from the salts of alkaline or earth alkaline metals of carboxylic acids, sulfonates, salicylates, naphthenates, as well as salts of phenates.

The alkaline and earth alkaline metals are preferentially calcium, magnesium, sodium or barium.

These metal salts may contain the metal in an approximately stoichiometric amount or else in excess (in an amount greater than the stoichiometric amount). In the latter case, one is dealing with so-called overbased detergents.

The excess metal providing the overbased nature to the detergent exists as insoluble metal salts in the oil, for example a carbonate, hydroxide, oxalate, acetate, glutamate, preferentially carbonate.

In a same overbased detergent, the metals of these insoluble salts may be the same as those of the detergents soluble in the oil or else may be different. They are preferentially selected from calcium, magnesium, sodium or barium.

The overbased detergents thus appear as micelles consisting of insoluble metal salts maintained in suspension in the lubricating composition by the detergents as metal salts soluble in the oil.

These micelles may contain one or several types of insoluble metal salts, stabilized by one or more detergent types.

The overbased detergents including a single type of detergent soluble metal salt will generally be designated according to the nature of the hydrophobic chain of the latter detergent.

Thus, they will be said to be of the phenate, salicylate, sulfonate, naphthenate type depending on whether this detergent is a phenate, salicylate, sulfonate or naphthenate, respectively.

The overbased detergents will said to be of the mixed type if the micelles comprise several types of detergents, different from each other by the nature of their hydrophobic chain.

For a use in lubricant compositions according to the present invention, the metal salts soluble in the oil will preferentially be calcium, magnesium, sodium or barium phenates, sulfonates, salicylates, and mixed phenate-sulfonate and/or salicylate detergents.

According to a preferred embodiment of the present invention, the insoluble metal salt providing the overbased character is calcium carbonate.

The overbased detergents used in lubricant compositions according to the present invention will preferentially be phenates, sulfonates, salicylates and phenate-sulfonate-salicylate mixed detergents, overbased with calcium carbonate.

According to an embodiment of the present invention, at least 10% of one or more overbased detergent compounds are used, providing basicity to the lubricant in a sufficient amount for neutralizing the acids formed during combustion.

The amount of overbased detergents is conventionally determined in order to reach the targeted BN.

Base Oils.

Generally, the base oils used for formulating lubricants according to the present invention may be oils of mineral, synthetic or plant origin as well as their mixtures.

The mineral or synthetic oils generally used in the application belong to one of the classes defined in the API classification as summarized below:

| | Saturated substance content | Sulfur content | Viscosity index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing.

Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The cylinder oils for 2-stroke diesel marine engines have a viscosimetric grade SAE-40 to SAE-60, generally preferentially SAE-50 equivalent to a kinematic viscosity at 100° C. comprised between 16.3 and 21.9 $mm^2/s$. Depending on the uses of the profession, formulation of cylinder oils is preferred for 2-stroke diesel marine engines, having a kinematic viscosity at 100° C. comprised between 18 and 21.5, preferentially 19 and 21.5. This viscosity may be obtained by mixing additives and base oils for example containing mineral bases of Group 1 such as Neutral Solvent (for example 500NS or 600NS) bases and brightstock. Any other combination of mineral, synthetic bases or of plant origin, having as a mixture with the additives a viscosity compatible with the SAE-50 grade, may be used.

Typically, a conventional formulation of cylinder lubricant for slow 2-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class, i.e. obtained by distillation of selected crude oils followed by purification of these distillates by methods such as solvent extraction, solvent or catalytic dewaxing, hydrotreating or hydrogenation. Their viscosity index (VI) is comprised between 80 and 120; their sulfur content is greater than 0.03% and their saturated substance content is less than 90%.

Functional Additives.

The lubricant formulation according to the invention may also contain functional additives adapted to their use, for example dispersant additives, anti-wear additives, anti-foam additives, anti-oxidant and/or anti-rust additives. The latter are known to one skilled in the art. These additives are generally present at a weight content of 0.1-5%.

Dispersant Additives.

Dispersants are well-known additives used in the lubricant composition formulation, notably for application in the marine area. Their primary role is to maintain suspended the particles initially present or appearing in the lubricant composition during its use in the engine. They prevent their agglomeration by acting on steric hindrance. They may also have a synergistic effect on neutralization.

The dispersants used as additives for a lubricant typically contain a polar group, associated with a relatively long hydrocarbon chain generally containing from 50 to 400 carbon atoms. The polar group typically contains at least one nitrogen, oxygen or phosphorus element.

The compounds derived from succinic acid are dispersants particularly used as lubrication additives. Succinimides obtained by condensation of succinic anhydrides and amines, succinic esters obtained by condensation of succinic anhydrides and of alcohols or polyols, are used in particular.

These compounds may then be treated with various compounds, notably sulfur, oxygen, formaldehyde, carboxylic acids and compounds containing boron or zinc in order to for example produce borate succinimides or succinimides blocked with zinc.

Mannich bases obtained by polycondensation of phenols substituted with alkyl groups, of formaldehyde and of primary or secondary amines, are also compounds used as dispersants in lubricants.

According to an embodiment of the present invention, at least 0.1% of a dispersant additive is used. A dispersant in the family of PIB succinimides for example borates or blocked with zinc, may be used.

Other Functional Additives.

The lubricant compositions according to the present invention may also optionally contain other additives.

Mention will for example be made of anti-wear additives, which may for example be selected from the family of zinc dithiophosphates, of anti-oxidant/anti-rust additives, for example organometallic detergents or thiadiazoles, and of anti-foam additives for countering the effect of detergents, which may for example be polar polymers such as polymethylsiloxanes, polyacrylates.

According to the present invention, the compositions of the described lubricants refer to the compounds taken separately before mixing, it being understood that said compounds may either retain the same chemical form or not before and after mixing. Preferably, the lubricants according to the present invention obtained by mixing compounds taken separately are not in the form of an emulsion or micro-emulsion.

The surfactant compounds contained in the lubricants according to the present invention may notably be incorporated into a lubricant as a distinct additive, for example in order to increase the neutralization efficiency of an already known standard lubricant formulation.

The surfactants according to the invention in this case are preferably included in a standard formulation of cylinder lubricant for slow 2-stroke marine diesel engines of grades SAE 40 to SAE 60, preferentially SAE 50 (according to the SAE J300 classification).

This standard formulation comprises:

at least 50% by weight of a lubricant base oil of mineral and/or synthetic origin, adapted to the use in a marine engine, for example of the API Group 1 class, i.e. obtained by distillation of selected crude oils followed by purification of these distillates by methods such as solvent extraction, solvent or catalytic dewaxing, hydrotreating or hydrogenation. Their viscosity index (VI) is comprised between 80 and 120; their sulfur content is greater than 0.03% and their saturated substance content is less than 90%.

at least 10% of one or more overbased detergent compounds providing basicity to the lubricant in a sufficient amount for neutralizing the acids formed during combustion, which may for example be selected from detergents of the sulfonate, phenate, salicylate type;

at least 0.1% of a dispersant additive which may for example be selected from the family of PIB succinimides, and the primary role of which is to maintain suspended the particles initially present or appearing in the lubricant composition during its use in the engine; it also has a synergistic effect on neutralization;

and optionally, anti-foam, anti-oxidants and/or anti-rust and/or anti-wear agents such as for example those of the family of zinc dithiophosphates.

All the expressed mass percentages are based on the total weight of the lubricant composition.

Additive Concentrates for Marine Lubricants.

Surfactant compounds of the ester type contained in the lubricants according to the present invention may also be integrated into an additive concentrate for a marine lubricant.

The concentrate of additives for marine cylinder lubricants generally consist of a mixture of the constituents described above, of detergents, dispersants, other functional additives, pre-dilution base oil, in proportions with which after dilution in a base oil, cylinder lubricants may be obtained, having a BN determined according to the ASTM D-2896 standard, which is greater than or equal to 40 mg of potash per gram of lubricant. This mixture generally contains, based on the total weight of concentrate, a detergent content greater than 80%, preferably greater than 90%, a dispersant additive content from 2 to 15%, preferably 5 to 10%, a content of other functional additives from 0 to 5%, preferably from 0.1 to 1%.

According to an object of the invention, the additive concentrate for a marine lubricant comprises one or more surfactants of the ester type in a proportion with which it is possible to obtain an amount of surfactant in the cylinder lubricant according to the invention of 0.1% to 10%, preferably 0.1 to 2%.

Thus, the additive concentrate for a marine lubricant contains, based on the total weight of concentrate, preferably 0.05% to 30%, preferably from 0.5 to 25% by weight of one or more compounds (A) selected from esters of saturated fatty mono-acids including at least 14 carbon atoms and of alcohols including at most 6 carbon atoms.

According to an embodiment, the concentrate of additives for a cylinder lubricant contains from 0.05 to 80%, preferably from 0.5 to 50% or further 2% to 40% or further 6% to 30% or further 10 to 20% by weight based on the total weight of the additive concentrate, of one or more compounds (A) selected from esters of saturated fatty mono-acids including at least 14 carbon atoms and of alcohols including at most 6 carbon atoms.

According to a particular embodiment, the concentrate of additives contains from 15% to 80% by weight, based on the total weight of the additive concentrate, of one or more compounds (A) as defined above.

All these percentages are expressed by weight, based on the total weight of the concentrate, which also contains the base oil in a small amount, but sufficient for facilitating the application of said concentrate of additives.

Measurement of the Performance Difference, Between a Traditional Reference Lubricant and a Lubricant According to the Invention.

This measurement is characterized by an efficiency neutralization index measured according to the method of the enthalpy test described specifically in the examples and in which the progress of the exothermic neutralization reaction is tracked by the observed rise in temperature when the lubricant containing the basic sites is put into the presence of sulfuric acid.

Of course, the present invention is not limited to the described and illustrated examples and embodiment, but it is capable of having many alternatives accessible to one skilled in the art.

EXAMPLES

Example 1

This example aims at describing the enthalpy test with which the efficiency of neutralization of the lubricants with regard to sulfuric acid may be measured.

The availability or accessibility of the basic sites included in a lubricant, notably a cylinder lubricant for a 2-stroke marine engine, with regard to the acid molecules, may be quantified by a dynamic test for tracking the neutralization rate or kinetics.

Principle:

Acid-base neutralization reactions are generally exothermic and the evolvement of heat obtained by reaction of sulfuric acid on the lubricants to be tested may therefore be measured. This evolvement is tracked by the time-dependent temperature change in an adiabatic reactor of the DEWAR type.

From these measurements, an index quantifying the efficiency of an additived lubricant according to the present invention relatively to a lubricant taken as reference may be calculated.

This index is calculated relatively to the reference oil to which the value of 100 is assigned. This is the ratio between the reaction durations for neutralizing the reference ($S_{ref}$) and the measured sample ($S_{mes}$):

$$\text{Neutralization efficiency index}=S_{ref}/S_{mes}\times 100$$

The values of these neutralization reaction durations, which are of the order of a few seconds, are determined from temperature increase acquisition curves versus time during the neutralization reaction (see curve FIG. 1).

The duration S is equal to the difference $t_f-t_i$ between the time at the temperature of the end of the reaction and the time at the temperature of the beginning of the reaction.

The time $t_i$ at the temperature of the beginning of the reaction corresponds to the first rise in temperature after starting the stirring.

The time $t_r$ at the final reaction temperature is the one for which the temperature signal remains stable for a duration greater than or equal to half the reaction time.

The lubricant is all the more efficient since it leads to short neutralization times and therefore to a high index.

Equipment Used:

The geometries of the reactor and of the stirrer as well as the operating conditions were selected so as to be under chemical operating conditions, where the effect of diffusional constraints in the oil phase is negligible.

Consequently in the configuration of the equipment used, the fluid height should be equal to the inner diameter of the reactor, and the stirring propeller should be positioned at about ⅓ of the height of the fluid.

The apparatus consists of a 300 ml adiabatic reactor of the cylindrical type, the internal diameter of which is 52 mm and the internal height 185 mm, of a stirring rod provided with a propeller with tilted blades, with a diameter of 22 mm; the diameter of the blades is comprised between 0.3 and 0.5 times the diameter of the DEWAR, i.e. from 15.6 to 26 mm.

The position of the propeller is set at a distance of about 15 mm from the bottom of the reactor. The stirring system is driven by a motor with a variable speed from 10 to 5,000 revolutions per minute and with a system for acquiring temperature over time.

This system is adapted to the measurement of reaction times of the order of 5 to 20 seconds and to the measurement of a temperature rise of a few tens of degrees from a temperature of about 20° C. to 35° C., preferably about 30° C. The position of the temperature acquisition system in the DEWAR is fixed.

The stirring system will be adjusted in such a way that the reaction occurs under chemical operating conditions: in the configuration of the present experiment, the speed of rotation is adjusted to 2,000 revolutions per minute, and the position of the system is fixed.

Moreover, the chemical conditions of the reaction also depend on the height of oil introduced into the DEWAR, which should be equal to the diameter of the latter, and which in the scope of this experiment corresponds to a mass of about 86 g of the tested lubricant.

In order to test the BN 70 lubricants, the amount of acid corresponding to the neutralization of 55 BN points is introduced here into the reactor.

4.13 g of 95% concentrated sulfuric acid and 85.6 g of lubricant to be tested for a BN 70 lubricant for example, neutralized to 55 BN points, are introduced into the reactor.

After placing the stirring system inside the reactor so that the acid and the lubricant mix properly and repeatedly between two tests, the stirring is started in order to track the reaction under chemical conditions. The acquisition system is permanent.

Application of the Enthalpy Test—Calibration:

In order to calculate the efficiency indexes of the lubricants according to the present invention by the method described above, we choose to take as a reference the neutralization reaction time measured for a 2-stroke marine engine cylinder oil of BN 70 (as measured by ASTM D-2896) not including any surfactant additive according to the present invention.

This oil is obtained from a mineral base obtained by mixing a distillate with a specific gravity at 15° C. comprised between 880 and 900 kg/m$^3$ with a distillation residue of specific gravity comprised between 895 and 915 kg/m$^3$ (brightstock) in a distillate/residue ratio of 3.

To this base is added a concentrate in which calcium sulfonate with BN equal to 400 mg KOH/g, a dispersant, calcium phenate with BN equal to 250 mg KOH/g are again found in an amount required for obtaining a lubricant with BN of 70 mg KOH/g.

The thereby obtained lubricant has a viscosity at 100° C. comprised between 18 and 20.5 mm$^2$/s.

The neutralization reaction time of this oil (referenced as Href hereafter) is 10.3 seconds and its neutralization efficiency index is set to 100.

Two other lubricant samples with BN of 55 and 40 are prepared from the same concentrate of additives respectively diluted by 1.25 and 1.7 according to the desired BN and from a lubricant base, the distillate and residue mixture of which is adapted for finally obtaining a viscosity at 100° C. comprised between 19 and 20.5 mm$^2$/s.

These two samples, referenced as H55 and H40 hereafter are also free of additives, of surfactant additives according to the present invention.

Table 1 hereafter shows the values of the neutralization indexes obtained for the samples with BNs of 40 and 55 prepared by dilution of the additives included in the reference oil with BN of 70.

TABLE 1

| | BN | Neutralization efficiency index |
|---|---|---|
| Href | 70 | 100 |
| H 55 | 55 | 88 |
| H 40 | 40 | 77 |

Example 2

This example describes the influence of the additives (compounds (A)) according to the invention for a formulation with constant BN of 55.

The reference is the non-additived cylinder oil for a two-stroke marine engine with a BN of 70, according to the present invention and referenced as Href in the previous example.

The additived BN 55 samples to be tested are prepared from the non-additived lubricant referenced as H 55 in the previous example.

These samples are obtained by mixing in a beaker, at the temperature of 60° C., under sufficient stirring in order to homogenize the mixture of the lubricant H 55 to be additived and of the surfactant of the selected ester type. For a mixture with a surfactant content of x % m/m:

x g of ester (compound (A)) are introduced the mixture is completed to 100 with the lubricant H 55 to be additived.

Table 2 hereafter groups the values of the efficiency indexes of the different samples prepared in this way.

The BNs of the lubricants before and after introducing the surfactants according to the present invention were also measured according to the ASTM D-2896 standard.

TABLE 2

| No. | Non-additived lubricant | Additives | Additive % m/m | Neutralization efficiency index | BN (ASTM D-2896) |
|---|---|---|---|---|---|
| 1 | Href (BN 70) | | | 100 | 70 |
| 2 | H 55 | | | 88 | 54.8 |
| 3 | | Diesters of neopentyl glycol and of stearic acid (Priolube 1973) | 0.5 | 108 | 54.4 |
| 4 | | Ethylene glycol monostearate (Kemester EGMS Flakes) | 0.5 | 105 | 55.2 |

TABLE 2-continued

| No. | Non-additived lubricant | Additives | Additive % m/m | Neutralization efficiency index | BN (ASTM D-2896) |
|---|---|---|---|---|---|
| 5 | | Glycerol monostearate (Kemester 5500 Flakes) | 0.5 | 111 | 54.5 |
| 6 | | Methyl stearate | 0.5 | 111 | 55 |
| 7 | | Butyl stearate | 0.5 | 108 | 54.9 |
| 8 | | 2-ethylhexyl-2-ethyl hexanoate ($C_8$-acid, $C_8$-alcohol, Hatcol 2976) | 0.5 | 91 | 55.1 |
| 9 | | Methyl oleate (unsaturated acid, Kemester 104W BHT) | 0.5 | 86 | 54.8 |
| 10 | | Ester of decanoic acid and of octanoic acid and of 2-ethyl-(hydroxymethyl)-1,3-propane-diol ($C_8$ and $C_{10}$-acids, Hatcol 2938) | 0.5 | 91 | 54.4 |
| 11 | | Methyl myristate (C14 acid) | 0.5 | 99 | 54.6 |
| 12 | | Methyl behenate (C22) | 0.5 | 105 | 54.8 |

It is seen that the additived lubricants according to the present invention (Nos. 3 to 7 and 11-12) have at a BN of 55, a greater neutralization efficiency index than that of the same oil with BN of 55, not additived in this way.

Almost all the BN 55 oils additived according to the present invention have a neutralization efficiency index greater than that of a BN 70 oil not additived in this way, taken as a reference.

Moreover it may be noted that for the oils additived with esters outside the definition of the invention (Ex. 8-10), the neutralization efficiency indexes are very little improved or not at all.

The index values calculated for BN 55 oils according to the present invention are globally 12 to 25% greater than that of the reference, even though the introduction of additives according to the present invention has no or very little influence on the value of their BN.

What is claimed is:

1. A method for lubricating a two-stroke engine powered with any type of fuel oils, for which the sulfur content is less than 4.5% m/m said method comprising operating the engine with a single two-stroke cylinder lubricant having a BN determined according to the ASTM D-2896 standard, comprised in the range from 50 to 58 mg of KOH per gram of lubricant, and having a neutralization efficiency index superior or equal to 99, comprising a lubricant base oil for a marine engine and at least one overbased detergent based on alkaline or earth alkaline metals, wherein it further contains an amount of 0.01% to 10% by weight based on the total weight of the lubricant, of one or more compounds (A) selected from the group consisting of:

mono-esters of saturated fatty mono-acids having from 14 to 22 carbon atoms and of mono-alcohols including at most 6 carbon atoms.

2. A method for lubricating a two-stroke engine powered alternatively with both fuels with a sulfur content of less than 1.5% m/m and fuels with a sulfur content of greater than 3% m/m, comprising operating the engine with a single two-stroke cylinder lubricant according claim 1.

3. A method for preventing corrosion and/or reducing the formation of deposits of insoluble metal salts in a two-stroke marine engine powered with a fuel oil for which the sulfur content is less than 4.5% m/m, said method comprising operating the engine with a single two-stroke cylinder lubricant having a BN determined according to the ASTM D-2896 standard, comprised in the range from 50 to 58 mg of KOH per gram of lubricant, and having a neutralization efficiency index superior or equal to 99, comprising a lubricant base oil for a marine engine and at least one overbased detergent based on alkaline or earth alkaline metals, wherein it further contains an amount of 0.01% to 10% by weight based on the total weight of the lubricant, of one or more compounds (A) selected from the group consisting of:

mono-esters of saturated fatty mono-acids having from 14 to 22 carbon atoms and of mono-alcohols including at most 6 carbon atoms.

4. The method according to claim 1, wherein the sulfur content of fuel oils is comprised from 0.5% to 4% m/m.

5. A method for lubricating a two-stroke engine according to claim 1 wherein the fatty acids are selected from myristic, pentadecylic, palmitic, margaric, stearic, nonadecylic, arachidic, heneicosanoic, behenic acids.

6. A method for lubricating a two-stroke engine according to claim 1 wherein the alcohols are selected from ethanol, methanol, propanol and butanol.

7. A method for lubricating a two-stroke engine according to claim 1 comprising from 0.1% to 2% by weight of compounds (A) based on the total weight of the lubricant.

8. A method for lubricating a two-stroke engine according to claim 1 having a BN determined according to the ASTM D-2896 standard, comprised in the range from 54 to 56 mg of KOH per gram of lubricant.

9. A method for lubricating a two-stroke engine according to claim 1 which comprises one or more functional additives selected from dispersant additives, anti-wear additives, anti-foam additives, anti-oxidant and/or anti-rust additives.

10. A method for lubricating a two-stroke engine according to claim 1 which comprises at least one overbased detergent selected from the group formed by carboxylates, sulfonates, salicylates, naphthenates, phenates and mixed overbased detergents associating at least two of these types of detergents.

11. A method for lubricating a two-stroke engine according to claim 1 which comprises at least 10% of one or more overbased detergent compounds.

12. A method for lubricating a two-stroke engine according to claim 1 wherein the overbased detergents are compounds based on metals selected from the group consisting of calcium, magnesium, sodium and barium.

13. A method for lubricating a two-stroke engine according to claim 1 wherein the detergents are overbased with insoluble metal salts selected from the group consisting of carbonates, hydroxides, oxalates, acetates, glutamates of alkaline and earth alkaline metals.

14. A method for lubricating a two-stroke engine according to claim 1 wherein the overbased detergents are carbonates of alkaline or earth alkaline metals.

15. A method for lubricating a two-stroke engine according to claim 1 wherein at least one of the detergents is overbased with calcium carbonate.

16. A method for lubricating a two-stroke engine according to claim 1 which comprises at least 0.1% of a dispersant additive selected in the family of PIB succinimides.

* * * * *